US007604456B2

(12) United States Patent
Schiavo, Jr. et al.

(10) Patent No.: US 7,604,456 B2
(45) Date of Patent: Oct. 20, 2009

(54) VANE SHROUD THROUGH-FLOW PLATFORM COVER

(75) Inventors: Anthony L. Schiavo, Jr., Oviedo, FL (US); Bonnie D. Marini, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 478 days.

(21) Appl. No.: 11/401,987

(22) Filed: Apr. 11, 2006

(65) Prior Publication Data

US 2007/0237630 A1 Oct. 11, 2007

(51) Int. Cl.
*F04D 29/40* (2006.01)
*F03B 11/02* (2006.01)

(52) U.S. Cl. ..... 415/191; 415/209.3; 415/210.1

(58) Field of Classification Search ..... 415/115, 415/138, 139, 191, 200, 209.2–209.4, 210.1, 415/95

See application file for complete search history.

(56) References Cited

U.S. PATENT DOCUMENTS 3,008,689 A * 11/1961 Cook et al. ..... 416/221
3,752,598 A * 8/1973 Bowers et al. ..... 415/115
3,892,497 A 7/1975 Gunderlock et al.
4,326,835 A 4/1982 Wertz
4,802,824 A * 2/1989 Gastebois et al. ..... 416/193 A
4,957,412 A 9/1990 Olson et al.
5,115,642 A 5/1992 Cvelbar et al.
5,209,645 A * 5/1993 Kojima et al. ..... 416/241 B
5,244,345 A * 9/1993 Curtis ..... 416/95
5,281,097 A 1/1994 Wilson et al.
5,320,487 A 6/1994 Walker et al.
5,487,642 A 1/1996 Norton et al.
5,738,490 A 4/1998 Pizzi
5,823,741 A 10/1998 Predmore et al.
5,842,831 A * 12/1998 Galke et al. ..... 416/95
5,988,975 A 11/1999 Pizzi
6,013,592 A 1/2000 Merrill et al.
6,059,529 A 5/2000 Schiavo
6,139,264 A 10/2000 Schilling
6,197,424 B1 3/2001 Morrison et al.
6,214,248 B1 4/2001 Browning et al.
6,273,683 B1 8/2001 Zagar et al.
6,309,175 B1 * 10/2001 Hahnle et al. ..... 415/115
6,315,519 B1 * 11/2001 Bagepalli et al. ..... 415/135
6,454,526 B1 9/2002 Cunha et al.
6,533,544 B1 3/2003 Tiemann et al.
6,558,115 B2 5/2003 Tiemann
6,602,050 B1 8/2003 Scheurlen et al.
6,632,070 B1 * 10/2003 Tiemann ..... 415/191

(Continued)

*Primary Examiner*—Edward Look
*Assistant Examiner*—Sean J Younger

(57) ABSTRACT

A turbine vane array (10) for a combustion assembly (8) in a combustion turbine engine. The vane array (10) includes a plurality of stationary vane assemblies (12), each vane assembly (12) including at least one airfoil (24) and inner and outer shroud segments (26, 28) attached to opposing ends of the airfoil (24). The inner and outer shroud segments (26, 28) each include an inner face (34, 36) facing toward a gas path (13) extending through the vane array (10). A removable cover structure may be provided on the inner faces (34, 36) of the inner and outer shroud segments (26, 28). The cover structure may include removably attached insert elements (72, 72') that are positioned on the inner faces (34, 36) extending between upstream edges (44) and downstream edges (46) of the shroud segments (26, 28) and extending between adjacent airfoils (24).

20 Claims, 4 Drawing Sheets

U.S. PATENT DOCUMENTS 6,638,012 B2 10/2003 Bekrenev
6,670,046 B1 12/2003 Xia
6,692,227 B2 * 2/2004 Tomita et al. ..... 415/173.7
6,733,907 B2 5/2004 Morrison et al.
6,758,653 B2 7/2004 Morrison
6,887,040 B2 5/2005 Tiemann et al.
6,932,568 B2 8/2005 Powis et al.
7,094,021 B2 * 8/2006 Haubert ..... 415/115
2005/0141989 A1 6/2005 Sayegh et al.

* cited by examiner

VANE SHROUD THROUGH-FLOW PLATFORM COVER

BACKGROUND OF THE INVENTION

1. Field of the Invention

This invention relates to a combustion turbine vane shroud assembly, and more specifically, to a combustion turbine vane shroud assembly comprising a plurality of adjacent vane assemblies and a cover element extending across a gap between adjacent vane assemblies for covering a portion of the vane assemblies and for limiting leakage of gases through the gap between the vane assemblies.

2. Background Information

Generally, combustion turbines have three main assemblies, including a compressor assembly, a combustor assembly, and a turbine assembly. In operation, the compressor assembly compresses ambient air. The compressed air is channeled into the combustor assembly where it is mixed with a fuel. The fuel and compressed air mixture is ignited creating a heated working gas. The heated working gas is typically at a temperature of between 2500 to 2900° F. (1371 to 1593° C.), and is expanded through the turbine assembly. The turbine assembly generally includes a rotating assembly comprising a centrally located rotating shaft and a plurality of rows of rotating blades attached thereto. A plurality of stationary vane assemblies including a plurality of stationary vanes are connected to a casing of the turbine and are located interposed between the rows of rotating blades. The expansion of the working gas through the rows of rotating blades and stationary vanes or airfoils in the turbine assembly results in a transfer of energy from the working gas to the rotating assembly, causing rotation of the shaft. A known construction for a combustion turbine is described in U.S. Pat. No. 6,454,526, which patent is incorporated herein by reference.

The vane assemblies may typically include an outer platform element or shroud segment connected to one end of an airfoil for attachment to the turbine casing and an inner platform element connected to an opposite end of the airfoil. The outer platform elements may be located adjacent to each other to define an outer shroud, and the inner platform elements may be located adjacent to each other to define an inner shroud. The outer and inner shrouds define a flow channel therebetween for passage of the hot gases past the stationary airfoils. The adjacent platform elements of the outer and inner shrouds generally abut each other along a junction where a gap may be formed, which may permit leakage of gases from the flow channel, and which may result in reduced efficiency of the turbine.

The first row of vane assemblies, which typically precedes the first row of rotating blades in the turbine assembly, is subject to the highest temperatures of the working gas, and therefore may be provided with a cooling system including passageways in the vane assembly for a cooling fluid. However, the surfaces of the vane assemblies exposed to the hot gases in the flow channel may be subject to burning and damage. The damage to a platform element of the vane assembly may require replacement of the entire vane assembly, even when the airfoil is still in a serviceable condition.

Accordingly, it is an object of the present invention to provide vane shroud assembly for a combustion turbine engine including a structure for sealing across a gap between adjacent vane assemblies. It is a further object of the invention to provide a replaceable structure for sealing across the gap between adjacent vane assemblies while also providing a covering over exposed surfaces of the vane assemblies.

SUMMARY OF THE INVENTION

In accordance with one aspect of the invention, a combustion turbine vane array is provided comprising a plurality of elongated airfoils including at least first and second airfoils located adjacent to each other. A shroud portion extends between the first and second airfoils and includes an inner face. An insert element is positioned on the inner face of the shroud portion between the first and second airfoils and defines a surface for contacting a working gas passing through the turbine vane array.

In accordance with a further aspect of the invention, a combustion turbine vane array is provided comprising structure arranged annularly around a turbine casing and defining a gas path. The structure includes at least an airfoil and a shroud portion having an inner face facing into the gas path. The shroud portion is coupled to the airfoil adjacent a base portion of the airfoil and extends laterally from opposing sides of the airfoil. A cover structure is removably engaged on the inner face of the shroud portion and extends along at least one side of the airfoil adjacent the base portion.

In accordance with another aspect of the invention, a method of maintaining a vane array located within a combustion turbine engine is provided. The method comprises providing structure arranged annularly around a turbine casing and defining a gas path, where the structure includes at least one airfoil and a shroud portion having an inner face facing into the gas path. The shroud portion is coupled to the airfoil adjacent a base portion of the airfoil and extends from opposing sides of the airfoil. A cover structure is positioned on the inner face of the shroud portion and extends along at least one side of the airfoil adjacent the base portion. The method further includes the steps of removing the cover structure from the inner face of the shroud portion, and positioning a replacement cover structure on the inner face of the shroud portion.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
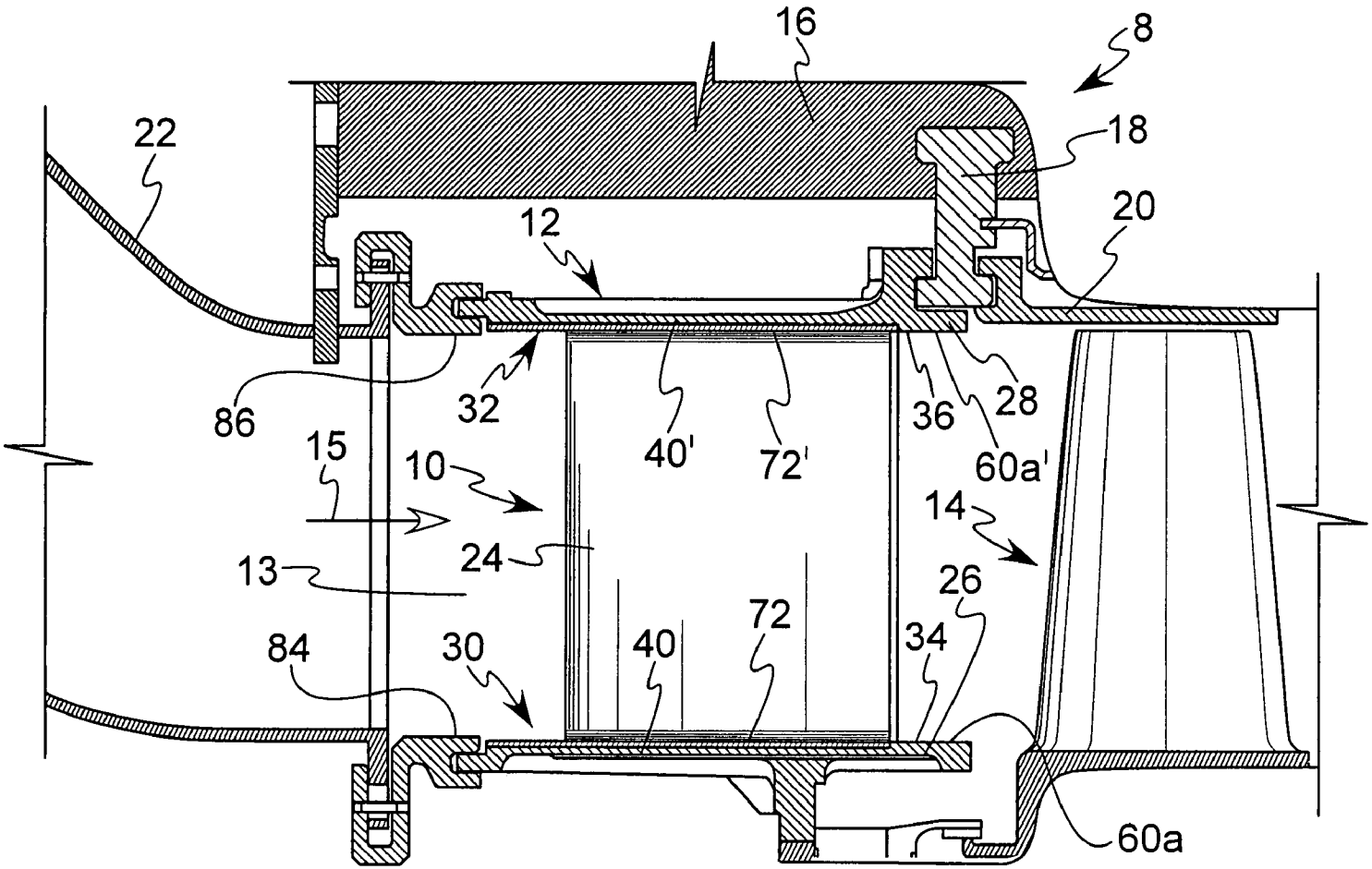
FIG. 1 is a cross-sectional side view of an entrance portion of a turbine assembly for a combustion turbine engine.

Referring to FIG. 1, the entrance to a turbine assembly 8 of a combustion turbine engine is shown and includes a turbine vane array 10 comprising a plurality of substantially similar stationary vane assemblies 12 (see also FIG. 2) and a plurality of rotating blades 14 (only one blade shown). The vane assemblies 12 are arranged annularly around an inner casing 16 of the turbine assembly 8 by support segments 18, which also may support ring segments 20 adjacent the rotating blades 14. The vane assemblies 12 define an annular gas path 13 for receiving a hot working gas flowing in a direction 15 from a gas duct 22 extending from a combustor (not shown) for the combustion turbine engine. The turbine assembly 8 may include a plurality of alternating arrays 10 of stationary vane assemblies 12 and sets of rotating blades 14 located axially along the turbine assembly 8. The vane assemblies 12 and blades 14 may be provided with a coolant, such as steam or compressed air, that may be circulated through the vane assemblies 12 and blades 14, as is further described in the above-referenced U.S. Pat. No. 6,454,526.

Figure 2:
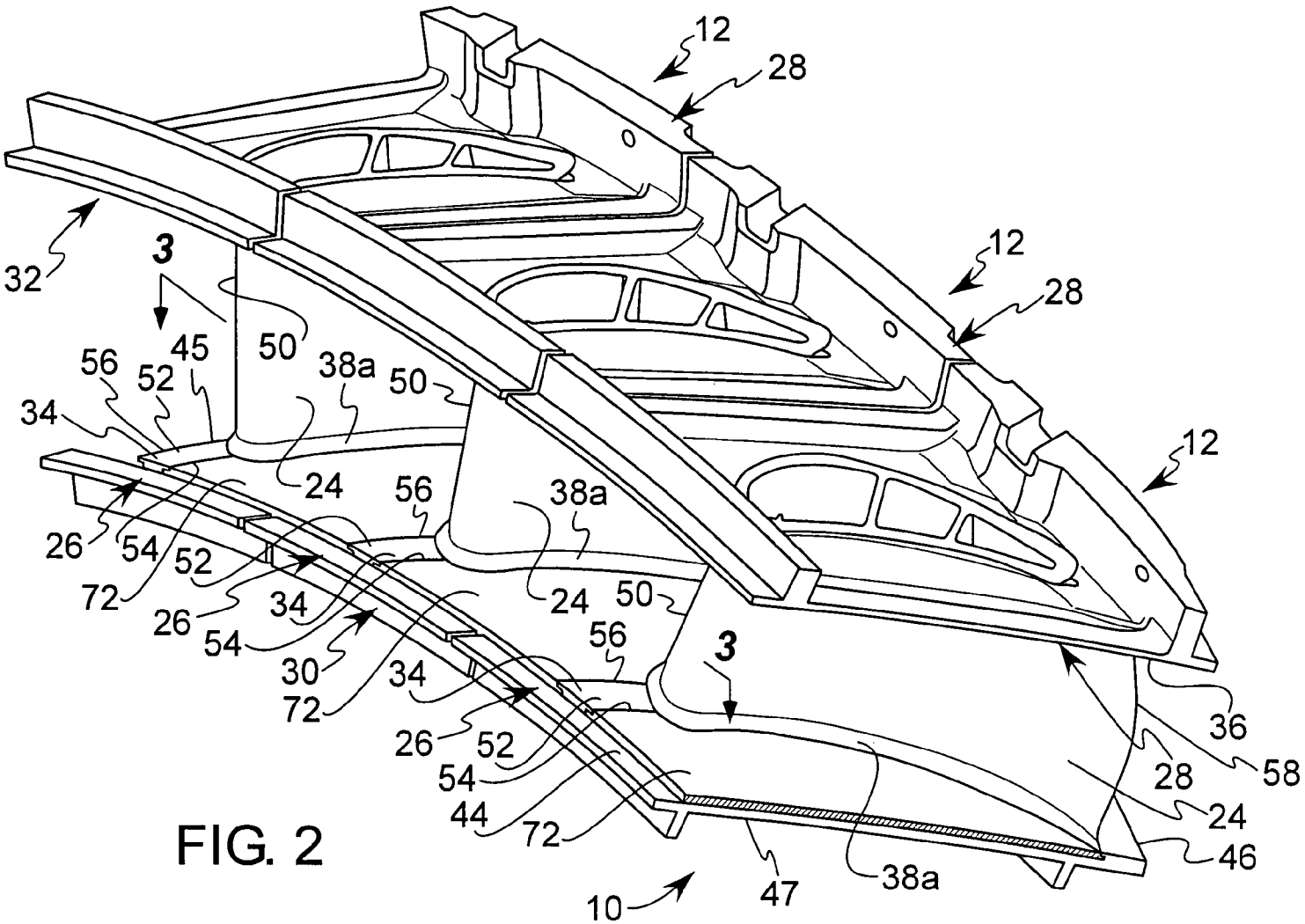
FIG. 2 is a perspective view of a portion of a stationary turbine vane array showing insert elements located in position on a shroud of the vane array.

Referring additionally to FIG. 2, the vane assemblies 12 generally comprise at least one elongated airfoil 24, an inner platform or shroud segment 26 and an outer platform or shroud segment 28 located at opposing ends of the airfoil 24 and forming an integral structure with the airfoil 24. The inner and outer shroud segments 26, 28 include respective inner faces 34, 36 connected to the airfoil 24 at base portions comprising fillets 38*a*, 38*b* (see also FIG. 3) located on opposing sides of the airfoil 24. The inner shroud segments 26 form an inner shroud portion 30 of the vane array 10 defining an inner boundary of the annular gas path 13, and the outer shroud segments 28 form an outer shroud portion 32 of the vane array 10 defining an outer boundary of the annular gas path 13.

Figure 4:
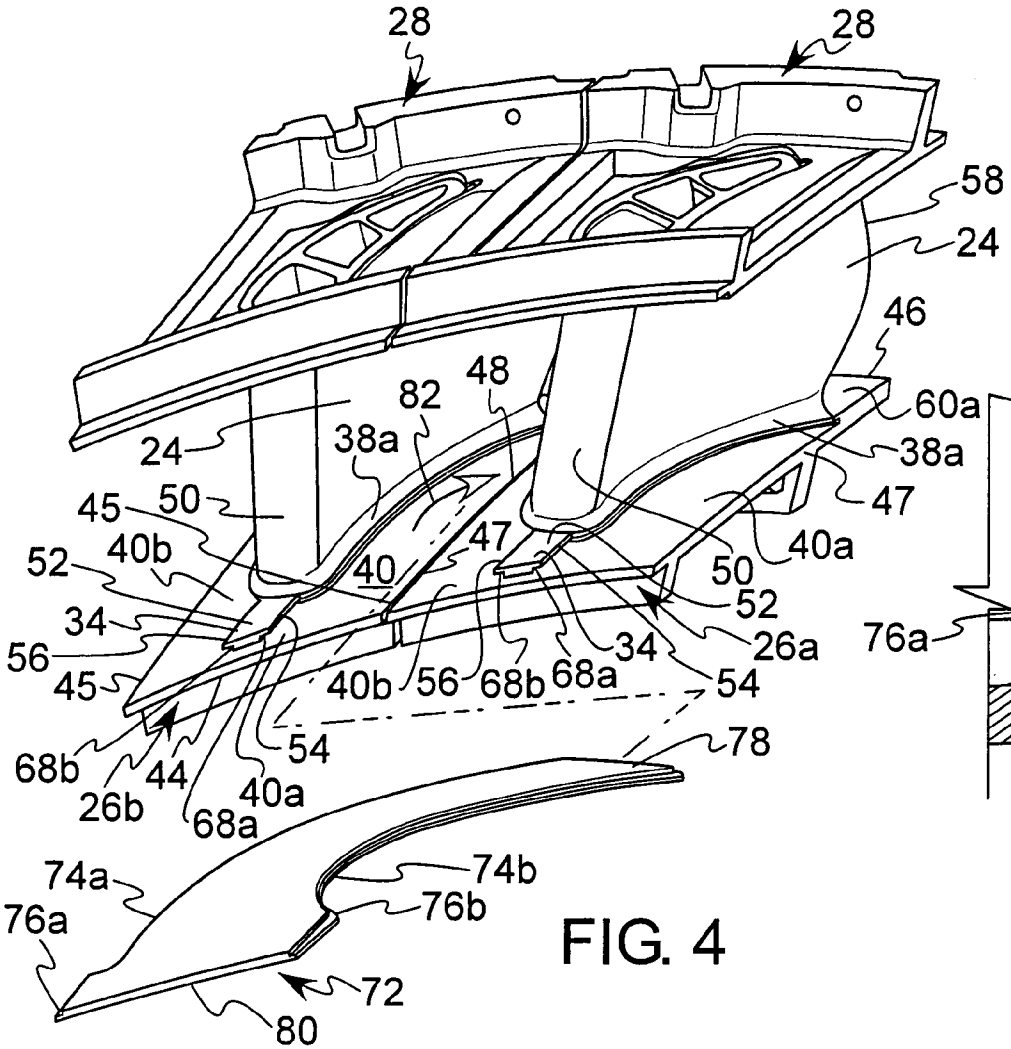
FIG. 4 is a perspective view of a portion of the vane array illustrating assembly of an insert element to the shroud of the vane array.

Referring to FIG. 1, the inner faces 34, 36 of the inner and outer shroud segments 26, 28 include respective recessed areas 40, 40' extending across a substantial portion of the inner faces 34, 36, see FIG. 4. The recessed areas 40, 40' will be described below with particular reference to recessed areas 40 defined on the inner faces 34 of the inner shroud segments 26; however, it should be understood that the recessed areas 40' of the outer shroud segments 28 may be provided with a construction similar to that described for the recessed areas 40.

Referring to FIG. 4, each recessed area 40 extends in a longitudinal direction, between an upstream edge 44 and a downstream edge 46 of the inner shroud portion 30, and extends in a generally lateral direction between adjacent airfoils 24. As depicted in the present embodiment, each shroud segment 26 includes two recessed sections 40*a* and 40*b* generally extending on either side of the airfoil 24 and generally following a curvature of the fillets 38*a*, 38*b* (see FIG. 3) of the airfoil 24. Each recessed area 40 is formed by adjacent recessed sections 40*a*, 40*b* located on adjacent shroud segments 26 which, for the purposes of the present description, are labeled 26*a*, 26*b*. Each shroud segment 26*a*, 26*b* includes opposing lateral edges 45, 47 (see FIGS. 3 and 4). A junction 48 between the lateral edges 45, 47 of adjacent shroud segments 26*a*, 26*b* passes through a substantial portion of the recessed area 40, extending in the longitudinal direction from the upstream edge 44 to the downstream edge 46, see FIG. 4.

Figure 3:
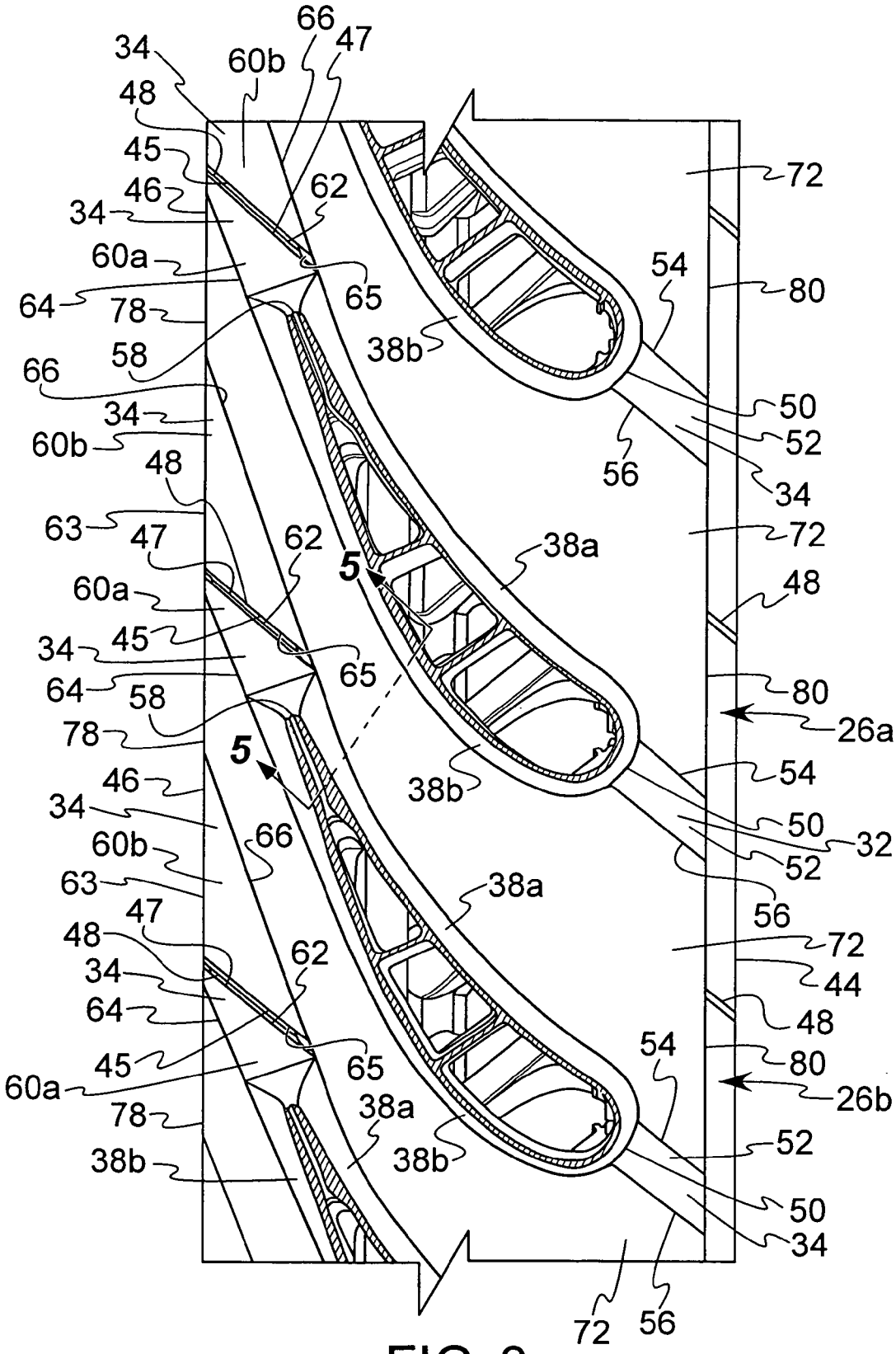
FIG. 3 is a cross-sectional top view of a portion of the turbine vane array taken along line 3-3 in FIG. 2.

Referring to FIG. 3, the inner face 34 includes an upstream non-recessed portion 52 having opposing edges 54, 56 extending between the upstream edge 44 and a leading edge 50 of the airfoil 24. The inner face 34 also includes first and second downstream non-recessed portions 60*a*, 60*b*. The first downstream non-recessed portion 60*a* comprises a generally triangular-shaped area that is generally located between the downstream edge 46 and a trailing edge 58 of the airfoil 24. An outer edge 62 of the first downstream non-recessed portion 60*a* generally extends along a portion of the lateral edge 47 from the downstream edge 46 to a location where the fillet 38*a* intersects the lateral edge 47. An inner edge 64 of the first downstream non-recessed portion 60*a* generally extends as a continuation of a line from the fillet 38*b* to a location substantially adjacent to the intersection of the outer edge 62 with the downstream edge 46.

The second downstream non-recessed portion 60*b* comprises a generally triangular-shaped area bounded by a rear edge 63 extending along a portion of the downstream edge 46, an outer edge 65 extending along a portion of the lateral edge 45, and a diagonal inner edge 66 located in spaced relation and generally parallel to the fillet 38*a* and inner edge 64. The diagonal edge 66 of the shroud segment 26*a* preferably forms a continuation of a line defined by the fillet 38*a* of the adjacent shroud segment 26*b*.

Figure 5:
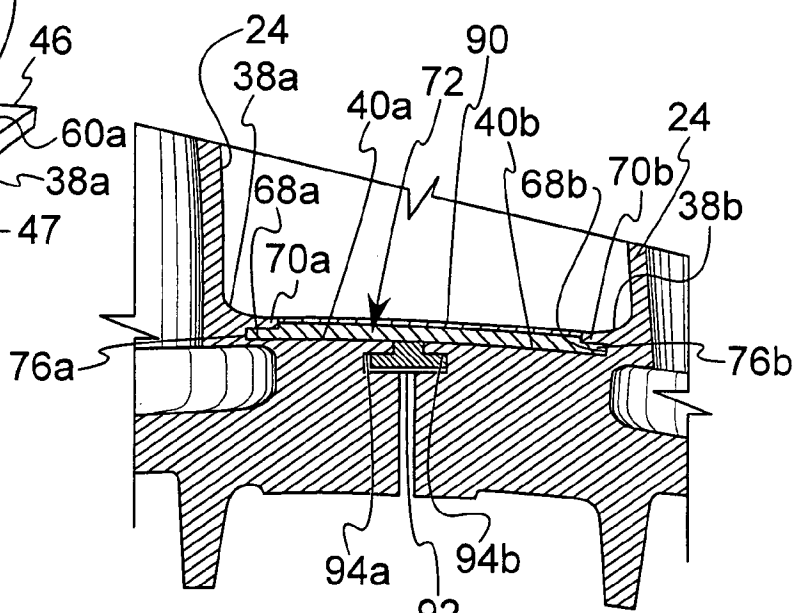
FIG. 5 is a cross-sectional elevation view taken along line 5-5 in FIG. 3 across a junction between two shroud segments.

Referring to FIGS. 3 and 4, the edges of the fillets 38*a*, 38*b* and the edges of the non-recessed portions 52, 60*a*, 60*b* adjacent the recessed area 40 are formed with substantially continuous grooves 68*a*, 68*b*, see FIGS. 4 and 5. For example, the groove 68*a* defines a side of the recessed area 40 extending along the edge 54 and fillet 38*a* of the shroud segment 26*b* and along the diagonal inner edge 66 of the adjacent shroud segment 26*a*; and the groove 68*b* extends along the edge 56, fillet 38*b* and inner edge 64 of the shroud segment 26*a*, see FIG. 3. The grooves 68*a*, 68*b* are each defined by a respective flange structure 70*a*, 70*b* overhanging the surface of the recessed area 40, see FIG. 5. The flange structure 70*a*, 70*b* and grooves 68*a*, 68*b* comprise an attachment structure for retaining an insert element 72 in the recessed area 40, as is described further below.

Referring to FIG. 4, the insert element 72 is preferably removably engaged on the inner face 34 of one or more of the shroud segments 26. In the described embodiment, the insert element 72 comprises a plate-like member that is positioned in the recessed area 40, where the thickness of the insert element 72 may generally correspond to the depth of the recessed area 40. In particular, the insert element 72 extends within the recessed sections 40*b*, 40*a* of two adjacent shroud segments 26*a*, 26*b*, respectively, and covers a substantial portion of a gap defined by the junction 48 between the adjacent lateral edges 45, 47, see also FIG. 3. The insert element 72 extends in a longitudinal downstream direction extending from the upstream edge 44 toward the downstream edge 46, and includes opposing lateral edges 74*a*, 74*b*. Each of the lateral edges 74*a*, 74*b* includes respective laterally extending tongue portions 76*a*, 76*b*, see also FIG. 5. The tongue portions 76*a*, 76*b* each define a reduced thickness of the insert element 72 and are dimensioned to fit within the grooves 68*a*, 68*b*.

The insert element 72 may be assembled onto the inner shroud portion 30 by sliding the insert element 72 through the recessed area 40 such that a downstream end 78 of the insert element 72 moves in the downstream direction from the upstream edge 44 toward the downstream edge 46. It should be noted that the lateral dimension of the insert element 72 is greater adjacent an upstream end 80 of the insert element 72 than adjacent the downstream end 78, and is sized to fit within corresponding dimensions between the grooves 68*a*, 68*b* of adjacent shroud segments 26*a*, 26*b*. Further, at least a portion of the lateral edges 74*a* and 74*b* of the insert element 72 are formed with convex and concave curvatures, respectively, to match the curvature of the fillets 38*a* and 38*b* at the base portions of the airfoils 24. During insertion of the insert element 72 into the inner shroud portion 30, in addition to sliding the insert element 72 in the longitudinal direction, the insert element 72 may also be rotated in a curved direction (see arrow 82 in FIG. 4), matching the curvature of the recessed area defined between the fillets 38*a*, 38*b*, to wedge the insert element 72 between adjacent airfoils 24.

The described insert element 72 permits a maintenance operation to be performed on the vane array 10 without removing the vane array 10 from the inner casing 16 of the turbine assembly 8. In particular, the vane array 10 may be accessed through an access cover (not shown) to permit an insert element 72, or insert elements 72, to be removed by sliding the insert element(s) 72 parallel to the inner face 34 in a direction from the downstream edge 46 toward the upstream edge 44. A replacement insert element 72, or replacement insert elements 72, may be assembled into the vane array by sliding the insert element(s) 72 parallel to the inner face 34 in a direction from the upstream edge 44 toward the downstream edge 46. It should be understood that the present description is not intended to limit the removal of an insert element 72 and replacement or positioning of an insert element 72 on the inner face to require that a different insert element 72 be provided during the replacement step. For example, if an insert element 72 is removed and inspected and found to be in serviceable condition, the same insert element 72 may be replaced or reassembled to the inner face 34 of the shroud segment 26

The insert element 72 is preferably formed of a material or materials that will provide an insulating layer on the inner faces 34 of the shroud segments 26. With the working as having a temperature as high as 2900° F., the insert element should be formed from a material having thermal resistance sufficient to operate in a high temperature environment. "Sufficient to operate" used in this context means that the insert element has suitable mechanical integrity to function with its intended purpose during turbine operation. Preferred materials for forming the insert element include, without limitation, ceramic materials or metals such as superalloys. For example, the insert element 72 may be formed of an oxide based ceramic matrix composite (CMC). Alternatively, the insert element 72 may be formed of a superalloy comprising, without limitation, one of the following: RENE 80, INCONEL 738, INCONEL 939, CMSX-4, Mar M002, CM 247 LC, Siemet or PW 1483. In the case of forming the insert element 72 of a superalloy, it may be necessary to provide the insert element 72 with film holes of a size and spacing to facilitate cooling of the shroud segment 26. In addition, the surface of the insert element 72 facing the gas path 13 may be provided with a thermal barrier coating 90 (FIG. 5). For example, an insert element 72 formed of a superalloy may include a thermal barrier coating formed of a sprayed ceramic barrier coating; and an insert element 72 formed of CMC may include a thermal barrier coating (TBC) formed of a friable graded insulation (FGI) such as a friable graded insulation disclosed in U.S. Pat. No. 6,670,046, which patent is incorporated herein by reference. Additional materials that may be used in forming the insert element 72 and thermal barrier coating 90 may be found in U.S. Pat. Nos. 6,013,592, 6,197,424 and 6,733,907, which patents are incorporated herein by reference.

It should be noted that materials for forming the vane assemblies 12 may include materials permitting use of an investment casting process. Such materials may include the superalloy materials described above for the insert element 72, including RENE 80, INCONEL 738, INCONEL 939, CMSX-4, Mar M002, CM 247 LC, Siemet, PW 1483, or equivalent materials.

A plurality of the insert elements 72 are provided to define a cover structure for covering a substantial portion of the inner face 34 of the inner shroud portion 30. Further, as noted above, the outer shroud segments 28 may include recessed areas 40' similar to those of the inner shroud segments 26. For example, the outer shroud segments 28 may include recessed areas 40' and non-recessed portions (60*a*' shown in FIG. 1) that generally mirror those described above for the inner shroud segments 26. As illustrated in FIG. 1, the recessed area 40' may receive an insert element 72' having a configuration substantially similar to that described for the insert element 72. Accordingly, a plurality of the insert elements 72' may form a cover structure for the inner face 36 of the outer shroud portion 32.

Referring to FIG. 1, the insert elements 72, 72' may be held in position by respective mouth seals 84, 86 that are connected between the gas duct 22 and the inner and outer shroud portions 30, 32, where the mouth seals 84, 86 may prevent the insert elements 72, 72' from sliding toward the upstream direction. It should be understood that other structure may be provided adjacent the upstream end 80 of the insert elements 72, 72' for limiting movement of the insert elements 72, 72' out of the recessed areas 40, 40'. Further, it should be understood that providing a structure for preventing the insert elements 72, 72' from sliding out of the recessed areas 40, 40' is not essential to operation of the invention in that gases flowing downstream though the gas path 13 will tend to bias the insert elements 72, 72' toward engagement within their respective recessed areas 40, 40' during operation of the engine.

Referring to FIG. 5, in order to further reduce or prevent gases from passing through the junction 48, a seal 92 may be provided in grooves 94*a*, 94*b* formed in adjacent inner shroud segments 26 below the face 34. The seal 92 may extend along all or a portion of the junction 48. In particular, it may be desirable to provide the seal 92 at least along the portion of the junction 48 where the inner face 34 is exposed to gases passing through the gas path 13, i.e., along the portion of the junction 48 in the area between the outer edges 62, 65 of the first and second downstream non-recessed portions 60*a*, 60*b*. Similarly, the outer shroud segments 28 may be provided with seals (not shown) for further limiting or preventing passage of gases through the inner face 36 of the outer shroud portion 32. The seal 92 may be biased in an outward direction, i.e., in the direction of the insert element 72 as shown in FIG. 5, by a fluid pressure applied behind the seal 92.

The insert elements 72, 72' described above are intended to limit leakage of gases through the inner and outer shroud portions 30, 32 to improve the efficiency of the engine, as well as direct any leakage flow around the lateral edges 74*a*, 74*b* adjacent the base portions of the airfoils 24 where a cooling fluid is generally provided for cooling the airfoils 24. The insert elements 72, 72' also provide a replaceable cover for protecting a substantial portion of the inner faces 34, 36 of the shroud segments 26, 28 from hot gases passing through the turbine assembly 8. Hence, in the event that the shroud segments 26, 28 are subject to burning or other damage during operation of the engine, the insert elements 72, 72' may be replaced rather than replacing the entire vane assembly 12. Further, the insert elements 72, 72' may provide additional thermal protection to the shroud portions 30, 32, particularly around the base portion of the airfoils 24, which is preferably substantially surrounded by the insert elements 72, 72'.

It should be understood that although the present description is directed to insert elements that span across a junction between adjacent shroud segments, the described insert elements may also be provided to vane assembly constructions including two airfoils sharing a common shroud segment, where an insert element may be provided between the two airfoils of the vane assembly. Further, other structure than that disclosed herein may be provided for removably attaching the insert elements to the shroud portions.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A combustion turbine vane array comprising:

a plurality of elongated airfoils including at least a first airfoil and a second airfoil located adjacent to each other;

a shroud portion defining an inner face extending laterally from said first airfoil to said second airfoil and extending longitudinally from a leading edge of said first airfoil to a trailing edge of said first airfoil, said inner face defining an annular boundary of a gas path directing a flow of a working gas through a turbine casing, and said inner face comprising a face surface facing radially inwardly toward the gas path, wherein said shroud portion forms an integral structure with said first airfoil; and an insert element extending from said first airfoil to said second airfoil and positioned in engagement on said face surface of said inner face of said shroud portion between said first and second airfoils, and defining a surface for contacting the working gas passing through said turbine vane array and an opposite surface engaging said inner face from said leading edge of said first airfoil to said trailing edge of said first airfoil.

2. The vane array of claim 1, wherein said shroud portion includes a recessed area and said insert element is removably positioned on said inner face in said recessed area.

3. The vane array of claim 2, including a flange structure overhanging side edge portions of said recessed area to define grooves and said insert element includes tongue portions extending into said grooves to retain said insert element in said recessed area.

4. The vane array of claim 3, wherein said shroud portion extends laterally from respective junctions between said first and second airfoils and said shroud portion, and said grooves extend along said respective junctions between said first and second airfoils and said shroud portion.

5. The vane array of claim 1, wherein said shroud portion is defined by first and second shroud segments extending laterally from respective sides of said first and second airfoils and defining respective recessed sections of said inner face positioned adjacent to each other along a junction formed where a lateral edge of said first shroud segment abuts a lateral edge of said second shroud segment, and said insert element being positioned on said recessed sections of said inner face and extending across said junction.

6. The vane array of claim 5, wherein said first and second airfoils form integral structures with said first and second shroud segments, respectively.

7. The vane array of claim 1, wherein said insert element comprises a plate-like member having a thermal barrier coating defining said surface for contacting said working gas.

8. The vane array of claim 7, wherein said insert element comprises a material having thermal resistance sufficient to operate in a high temperature environment.

9. The vane array of claim 8, wherein said thermal barrier coating comprises a friable graded insulation.

10. The vane array of claim 7, wherein said insert element comprises an alloy or a composite.

11. The vane array of claim 10, wherein said thermal baffler coating comprises a ceramic coating.

12. A combustion turbine vane array comprising:

structure arranged annularly around a turbine casing and defining a gas path, and including at least a first airfoil;

said structure comprising a shroud portion including an inner face comprising a face surface facing radially inwardly into said gas path, said shroud portion comprising a shroud segment coupled to said first airfoil adjacent a base portion of said first airfoil and extending laterally outwardly from junctions with said first airfoil at opposing sides of said first airfoil to respective lateral edges located in laterally spaced relation to said junctions and said shroud portion extending longitudinally from a leading edge of said first airfoil to a trailing edge of said first airfoil; and a cover structure removably engaged on said inner face of said shroud portion from said leading edge of said first airfoil to said trailing edge of said first airfoil and extending along said face surface of said inner face from at least one of said junctions at least to a respective lateral edge and along at least one side of said first airfoil adjacent said base portion.

13. The vane array of claim 12, wherein said cover structure extends in engagement with said face surface of said inner face along said opposing sides of said airfoil adjacent said base portion.

14. The vane array of claim 13, wherein said cover structure comprises at least two insert elements removably positioned on said inner face and extending along said opposing sides of said airfoil.

15. The vane array of claim 14, including a plurality of airfoils including at least said first airfoil and adjacent airfoils located adjacent to said first airfoil, said adjacent airfoils each including a shroud segment extending laterally from opposing sides of said adjacent airfoils and defining a radially inwardly facing surface of an inner face, said shroud segments of said first and adjacent airfoils located adjacent to each other and abutting each other at respective shroud segment junctions, wherein each of said at least two insert elements extend in engagement with said inner face from said first airfoil to a base portion of a respective adjacent airfoil and span a shroud segment junction.

16. A method of maintaining a vane array located within a combustion turbine engine, comprising the steps of:

providing structure arranged annularly around a turbine casing and defining a gas path, said structure including a plurality of airfoils and a shroud portion spanning between said airfoils and having an inner face comprising a face surface facing radially into said gas path, said shroud portion being coupled to said airfoils adjacent a base portion of each of said airfoils and extending laterally outwardly from junctions between said shroud portion and each said airfoil at opposing sides of said airfoils and said shroud portion extending longitudinally from a leading edge of a first one of said airfoils to a trailing edge of said first one of said airfoils;

providing a cover structure positioned on and engaging said inner face of said shroud portion from said leading edge of said first one of said airfoils to said trailing edge of said first one of said airfoils and extending along said face surface of said inner face from at least one of said junctions located along at least one side of said airfoil adjacent said base portion to one of said junctions located along a side of an adjacent airfoil;

removing said cover structure from said inner face of said shroud portion; and positioning a replacement cover structure on said inner face of said shroud portion.

17. The method of claim 16, wherein said steps of removing said cover structure and positioning a replacement cover structure are performed with said vane array located within said turbine casing.

18. The method of claim 16, wherein each of said steps of removing said cover structure and positioning a replacement cover structure are performed by sliding a respective insert element along said face surface of said inner face in a direction generally parallel to said face surface.

19. The method of claim 18, wherein said face surface comprises a recess portion and said respective insert elements define a thickness generally corresponding to a depth of said recess portion.

20. The method of claim 18, wherein said shroud portion comprises an upstream edge and a downstream edge, and said step of removing said cover structure comprises moving said respective insert element in a direction from said downstream edge toward said upstream edge and said step of positioning a replacement cover structure comprises moving said respective insert element in a direction from said upstream edge toward said downstream edge.

* * * * *

UNITED STATES PATENT AND TRADEMARK OFFICE

CERTIFICATE OF CORRECTION

PATENT NO. : 7,604,456 B2
APPLICATION NO. : 11/401987
DATED : October 20, 2009
INVENTOR(S) : Schiavo, Jr. et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 670 days.

Signed and Sealed this

Fifth Day of October, 2010

David J. Kappos

David J. Kappos
*Director of the United States Patent and Trademark Office*